US005765717A

United States Patent [19]

Gottselig

[11] Patent Number: 5,765,717

[45] Date of Patent: Jun. 16, 1998

[54] WET HYGIENIC TOWEL DISPENSER

[76] Inventor: John C. Gottselig, 405 S. Jackson St., Wilmington, Del. 19805

[21] Appl. No.: 838,564

[22] Filed: Apr. 9, 1997

Related U.S. Application Data

[63] Continuation of Ser. No. 432,677, May 2, 1995, abandoned, which is a continuation-in-part of Ser. No. 127,438, Sep. 27, 1993, abandoned, which is a continuation of Ser. No. 893,343, Jun. 3, 1992, Pat. No. Des. 347,534.

[51] Int. Cl.[6] ..... A47K 10/24

[52] U.S. Cl. ..... 221/45; 206/233; 242/595

[58] Field of Search ..... 221/33, 45, 46; 206/233, 812, 494; 242/560, 595, 905, 594.5, 598.5

[56] References Cited

U.S. PATENT DOCUMENTS 3,837,595 9/1974 Boone ..... 242/595
4,106,617 8/1978 Boone ..... 242/595

*Primary Examiner*—Kenneth Noland
*Attorney, Agent, or Firm*—Evelyn M. Sommer

[57] ABSTRACT

Wet towelette dispensers are provided which include a roll of moistened, flushable towelettes, each of which is readily separable along perforated lines from a remaining portion of the towelette roll. The towelettes are designed to have a high enough wet strength to be useful for hygienic applications. The roll is disposed in a sealable housing which has a slotted opening therein for permitting the removal of one more of the towelettes from the dispenser in a manner similar to the way dry toilet paper is typically dispensed.

13 Claims, 5 Drawing Sheets

WET HYGIENIC TOWEL DISPENSER

This application is a continuation of application Ser. No. 08/432,677 now abandoned, filed on May 2, 1995, which is a continuation-in-part of Ser. No. 08/127,438 filed on Sep. 27, 1993, now abandoned, which is a continuation of Ser. No. 07/893,343, filed on Jun. 3, 1992, now Pat. No. D 347,534.

FIELD OF THE INVENTION

This invention relates to the field of hygienic tissues and paper products for use in a bathroom, and more particularly, to pre-moistened or moistenable towelettes disposed in roll form and containers for housing them.

BACKGROUND OF THE INVENTION

Flushable, pre-moistened, sanitary wipes have been available in the marketplace since at least the mid-1970's, and typically comprise a web of soft, fibrous material, such as tissue paper, bonded together with a reinforcing layer that contains a water-dispersible material. The web is often patterned and cut into napkin-sized towelettes. A stack of these towelettes is then moistened and protected from evaporation in a sealable plastic container. Pre-moistened towelettes can be stored for lengthy periods of time, even periods exceeding a year.

When intended for use in and around the bathroom, for example, as toilet paper or a baby wipe, pre-moistened tissue has to be pliable enough to permit easy disposal within the vortex of a toilet bowl ("flushability"), but also has to have sufficient strength to be useful in abrasive hygienic applications ("wet strength"). Another desirable property for the towelettes is "biodegradability"; in other words, the towelettes have to be capable of being decomposed by natural biological processes in, for example, sanitary sewer systems or landfills.

One popular, pre-moistened tissue material is disclosed in Grach et al., U.S. Pat. No. 3,881,210 (hereby incorporated by reference), and is believed to be sold by Scott Paper Company, Philadelphia, Pa., under the trademark "WET WIPES". The pre-moistened wipes of Grach et al. contain a reinforcing layer containing a thin film of polyvinyl alcohol Add water-dispersible polyvinyl acetate. This reinforcing layer is laminated to a web of soft, fibrous material, and the resultant product is pre-moistened to a moisture content of about 100–350 wt. %. Upon flushing the "WET WIPES" product, the reinforcing layer is dispersed in the water vortex of the toilet so that it can be readily disposed of without clogging the plumbing.

Once a solution to the problem of preparing a flushable soft web that has sufficient wet strength to be used as a sanitary towelette was solved, artisans quickly sought a dispenser for placing a multiplicity of these towelettes in the bathroom or nursery. Initially, a stack of the pre-moistened towelettes was inserted into a simple rectangular box having a hinged lid. It soon became apparent, however, that opening the sealed lid and removing a single wipe from a moistened stack required a certain amount of manual dexterity and patience. In addition, a certain amount of drying took place on the opening of the box.

More convenient means for housing and accessing wet towelettes were lager developed in an attempt to solve these problems. See Phillips, U.S. Pat. No. 4,978,095, Boone, U.S. Pat. No. 4,406,617 (Boone '617), and Boone, U.S. Pat. No. 3,837,595 (Boone '595) all of which are hereby incorporated by reference. In Phillips and Boone '595, a roll of wet towelettes was provided, the roll being arranged in a vertical position and towelettes were then removed from the center of the roll by twisting one or more towelettes at a time through a central opening of a vertically-positioned cylindrical container. In Boone '617, a wet towelette dispenser was described which could be alternatively mounted in a conventional dry toilet paper holder or by means of mounting arms associated with a dry toilet paper spindle posterior to a roll of dry toilet paper. In addition to a vertically-positioned cylindrical container such as described in 'Boone '595, Boone '617 describes both a horizontally-positioned cylinder and box-like wet towelette dispenser. Horizontal stability is provided to the dispensers by means of positioning appendages or legs extending inwardly from the mounting arms and resting against the wall of the bathroom or the like on which the dispenser is mounted.

The devices disclosed by Phillips and Boone have not, however, been commercially implemented for "WET WIPES" type products. Some of the reasons for this could be the fact that they are inconvenient to set up and use, or they require additional hardware which is not readily adapted for use in a conventional bathroom.

SUMMARY OF THE INVENTION

This invention relates to flushable, biodegradable, pre-moistened or "moistenable" towelettes and sealable dispensers for containing this type of tissue.

Dispensers of this invention contain a roll of substantially biodegradable pre-moistened or moistenable towelettes, or wipes, which are easily separable from each other along perforated lines, and which have high degree of wet strength, but are readily flushable or dispersible in a toilet vortex. The towelettes may be made of recycled fibers.

The dispenser may house a container component in which liquid may be placed to wet the moistenable towelettes or to keep moistened towelettes from going dry. In an embodiment of the invention, the moistenable towelette roll is provided in a dry condition and once in the dispenser is wetted by a liquid added to the container. Such wetting can be accomplished by a wick disposed such that it wicks liquid from the container to the roll of moistenable towelettes. The wick is preferably made of material and mechanically positioned such that, the wick is maintained in contact with the moistenable roll as towelettes age removed from the moistenable towelette roll.

The roll of pre-moistened or moistenable towelettes is disposed in a substantially-sealable housing so that the towelettes are in a position for convenient dispensing and use and so that the wetted towelettes do not loose significant moisture. Preferably the housing should be capable of preventing pre-moistened towelettes from substantially losing their moisture by evaporation for at least 3–6 months . The housing is provided with also a slotted opening for permitting the removal of one or more towelettes at a time. Preferably, the slotted opening is formed in a plastic material attached to the dispenser housing. The plastic material is selected as to be of such thinness and resilience that the slot assumes a closed, or approximately closed state, or in alternative bears firm against the towelette material when a towelette is not being pulled from the dispenser, but which permits the towelette to be removed from the dispenser when it is pulled. A retaining means for retaining the free end of the roll of pre-moistened or moistenable towelettes may be provided in proximity to the slotted opening to avoid having the free end of the roll of towelettes slide back into the container during use. A serrated-edge may be affixed on the housing near the slotted opening to aid in separating the towelettes. The housing further contains an "access" opening for inserting the towelette roll into the dispenser which might for example be constructed as a hinged door.

The towelettes of this invention may be wetted with a liquid containing water, alcohols (e.g. ethanol and propanol), condensation products of aliphatic alcohols and ethylene oxide, emollients (such as hydrophilic petrolatum), protectants (such as dimethicone and lanolin), lubricants (such as mineral oil), anionic, cationic or non-ionic surfactants (such as dialkyl sodium sulfosuccinates, quaternary ammonium salts, and stearyl alcohols, respectively), polymeric dispersing agents (such as polymeric polycarboxylates), anionic, cationic, non-ionic, colloidal or other type of emulsifiers (such as triethanolamine stearate, cetyltrimethylammonium bromide, polyoxyethylene fatty alcohol ethers, acacia, and magnesium hydroxide, respectively), anti-bacterials (such as boric acid and polymixin B sulfate), antifungal agents (such as miconazole), other medicinal agents (such as anti-hemorrhoidal agents) and/or perfumes.

Accordingly, this invention provides wet towelettes in a manner which most clearly resembles the dispensing of dry toilet tissue from a roll. Instead of wrestling with the problem of a wet towelette that has been funnelled through a tiny opening in a vertically disposed tube and erratically folded onto itself like a "rope", the towelettes of this invention can be neatly rolled up in the same manner that dry toilet tissue is now provided.

The dispensers of the present invention are designed to be mounted to existing dry toilet tissue roll hardware, in particular spindle-type dry toilet paper roll brackets, without the need for straps or expensive additional fixtures or hardware.

In the preferred embodiments of this invention, at least one spring-loaded button or extension is provided on one of the axial ends of a cylindrical housing to provide a dispenser which can be easily inserted between a pair of arms of an ordinary toilet tissue bracket. In a preferred embodiment, the spring-loaded extension apparatus comprises a spring-loaded button surrounded by a plurality of threaded rings which can be removed individually to incrementally reduce the size of the button.

The housing can be provided with extension tabs which prevent it from rolling when a individual towelette is drawn from the roll through the slotted opening. The housing can also include a serrated edge adjacent the slotted opening for permitting facilitated severing of one or more towelettes from the roll along perforated lines.

Furthermore, in the preferred embodiments of this invention, breakaway or removable extension tabs are affixed to the dispenser to permit substantially flush incidence with the bracket or mounting surface to which the dispenser is attached, thereby minimizing or preventing rotational movement of the dispenser when towelettes are removed from the dispenser. The breakaway extension tabs are generally made from friable material which permits breakage along a notch placed in the tab. The breakaway or removable extension tabs are attached such that they can be removed from the dispenser if they are not needed. The breakaway or removable extension tabs of the present invention may provide for arranging of the same at any angle in order to permit flush incidence with the bracket or mounting surface. The breakaway or removable extension tabs may be provided with an adhesive material to aid in holding the dispenser to the bracket or mounting surface.

In further embodiments of this invention, means are provided for combining both a pre-moistened or moistenable towelette roll and a roll of dry toilet tissue in one dispenser housing, or in two separate housings intimately connected to each other such as to approximate one dispenser (a "dual dispenser"). The dispenser generally is suspended a suitable distance above the floor by coupling of the dispenser to a horizontally-disposed, spindle-type dry toilet paper roll bracket. At least one set of breakaway or removable extension tabs are provided on the dual dispenser, at a point in proximity to the dry toilet paper roll bracket, to provide rotational stability of the dispenser when either the dry toilet paper or the pre-moistened or moistenable towelettes are removed from the dispenser.

Preferably, these dual purpose dispensers dispose the rolls on top of one another in a "vertically stacked" arrangement. In a preferred embodiment, the roll of dry toilet issue is placed in a superior position to the pre-moistened or moistenable roll. A partition may separate such unitary dispenser housing into two separate chambers, one chamber for the dry toilet tissue roll and the other chamber for the pre-moistened or moistenable towelette roll. Regardless of whether the rolls are separated by a partition or not, the pre-moistened or moistenable towelette roll is preferably housed in a substantially sealed housing to limit evaporation of moistening liquid and drying of the towelettes.

BRIEF DESCRIPTION OF THE DRAWINGS

The accompanying drawings illustrate preferred embodiments of this invention.

DETAILED DESCRIPTION OF THE INVENTION

Figure 1:
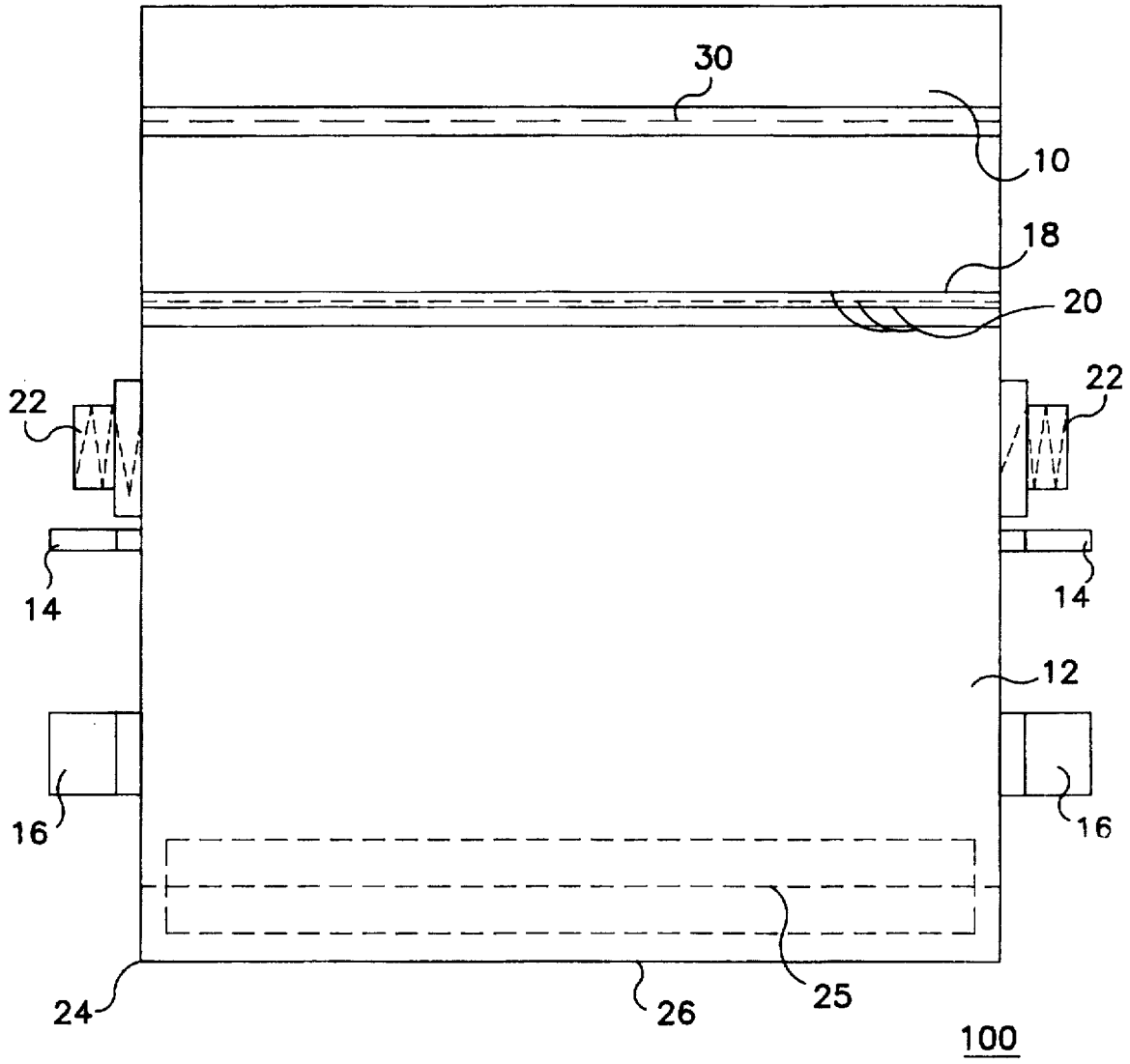
FIG. 1: is a front planar view of a preferred wet towelette dispenser of this invention.
Figure 2:
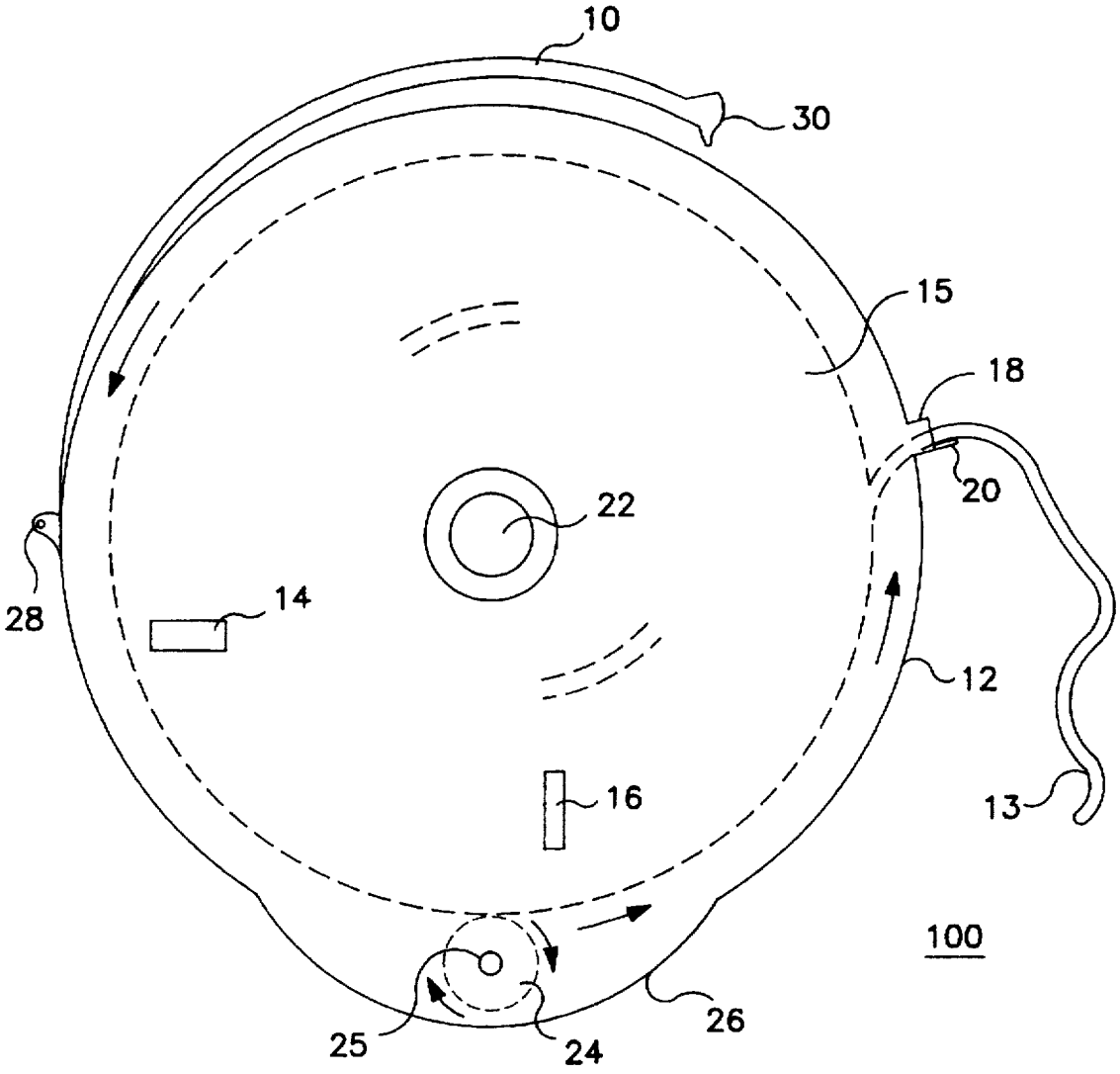
FIG. 2: is a side planar view of a preferred wet towelette dispenser of FIG. 1, illustrating, in phantom, a roll of towelettes, with a single towelette being withdrawn from a slotted opening.

Referring to the figures, and particularly to FIGS. 1 and 2 thereof, there is depicted a wet towelette dispenser 100 which is adapted for being snapped directly between a pair of arms of a typical 5.5 inch dry toilet tissue bracket. This particular dispenser 100 includes a polymeric housing 12 having a hinged lid 10. The lid 10 preferably conforms as closely as possible to the outer configuration of the of the housing 12. In the side view depicted in FIG. 2, the housing has a circular cross-section and the lid 10 arcs about an upper surface of this circular cross-section. It is envisioned, however, that the housing need not be circular at all, and can exhibit an oblong or even a square or rectangular configuration, so long as the towelettes can be dispensed readily without constricting or inadvertently tearing them.

The lid 10 preferably is hinged to a rear portion of the housing 12, for example, with pin hinge 28. An entirely plastic hinge is also acceptable. At the front of the lid 10 there is preferably a lid latch 30, which serves for sealing the contents of the housing 12 to render it substantially air-tight to prevent the pre-moistened towelettes from drying out prior to use. The lid hatch can include an exterior handle portion which should be easy to manipulate by both small and large hands for servicing the dispenser with fresh rolls of towelettes.

The housing 12 also preferably contains an opening, ideally a horizontally-disposed slotted opening 18, located on a portion of the housing that faces outward. The slotted opening 18 can contain a serrated edge 20 for both permitting one or more towelettes 13 to be severed from the roll 15, and to also keep the loose end of the roll 15 from being drawn back in to the dispenser. The slotted opening 18 is described in FIG. 2 as extending outwardly from the curved arc of the housing 12, but it can also be flush with the housing surface. During storage, the slotted opening can be taped closed to prevent evaporation of the pre-moistened towelettes. A hinged flap (not shown), preferably made of plastic like the housing, can be sealed over the opening to provide the same sealing ability.

The preferred dispenser 100 also includes a guide roll 24 located in a lower portion of the housing, and ideally within a definable quide roll cavity 26, which extends from a lower portion of the housing a sufficient distance to permit both the guide roll 24 and the full roll of wet towelettes 15 to move freely within the housing chamber. The guide roll can be designed to rotate freely about a guide roll axle 25 which, in combination with guide roll 24, permits the towelette roll to smoothly operate without impinging significantly against the lower inside surface of the housing 12.

Figure 2A:
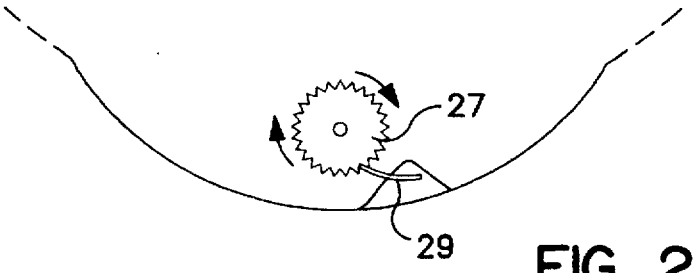
FIG. 2*a*: shows a preferred rotation limiting device for the guide roll shown in FIG. 2.

Although the guide roll is described as having a circular cross-section, it may have a "toothed" or "geared" portion 27, such as the one illustrated in alternative embodiment FIG. 2*a*. Similar to the operation of break tension equipment found in drum brakes used in automobiles, this gear portion could include a directionally-sensitive, rotation limiting device 29. Preferably the gear portion is located within the housing laterally along the axle 25 from the towelette roll so as to not interfere with the smooth rotation of the roll. In operation, as each towelette is removed, the gear would click over one or more teeth in order to ensure that the towelette roll 15 does not slide backwards and withdraw the end of the exposed towelette 13 back into the housing where it is less accessible to a user. Alternatively, the entire guide roll can include a roughened or geared surface for frictionally gripping or "digging" into the towelette roll to more assuredly prevent it from rolling in a reverse direction. Other methods for preventing the towelette roll from rolling backwards will be readily apparent to those of ordinary skill in the art once the remainder of the present invention becomes known.

The preferred dispenser 100 of this invention also include at least one spring-loaded button 22, although as depicted, the housing 12 contains two spring-loaded buttons 22. These buttons will enable simple insertion of the dispenser between a pair of arms of an ordinary toilet tissue bracket. The buttons can be configured in a variety of sizes and shapes to conform to the various commercial brackets on the market. The buttons may also contain a threaded portion which can be removed to provide a smaller button size for brackets that accept small spindles. One version of this button embodiment is described in FIG. 3 in which an outside ring 123 is affixed by threads 127 to interior button 122 to increase its diameter. If a smaller spindle hole is encountered in any particular dry roll bracket, the outer ring 123 an be removed from its threaded engagement with interior button 122. The spring 125, being located within the interior button 122, remains unaffected.

Alternatively, an axial opening can be provided through the container 12 approximately where the buttons 22 are located so that the dispenser 100 of this invention can be disposed along a conventional toilet tissue spindle (not illustrated).

Since the rotation of the towelette roll 15 could provide a rotational force to the housing itself, a set of breakaway or removable extension tabs 14 and 16 can be provided on either side of the housing for impinging against a bathroom wall, cabinet surface, or bracket surface to minimize or prevent housing rotation. In this way, the housing will remain in a stable location in its mounting bracket while individual towelettes are drawn from the slotted opening and severed along serrated edge 20. Although the breakaway or removable extension tabs 14 and 26 can be provided on either side of the housing for impinging against a bathroom wall, cabinet surface, or bracket surface to minimize or prevent housing rotation. In this way, the housing remains in a stable location in its mounting bracket while individual towelettes are withdrawn from the slotted opening and severed along serrated edge 20. Although the breakaway or removable extension tabs 14 and 16 are shown in horizontal and vertical positions, they can be disposed at any angle which permits substantially flush incidence with a bracket or mounting surface. Preferably, the breakaway or removable extension tabs 14 and 16 contain a notch so that they can be easily broken and removed from the housing 12 if they are not needed for service.

Figure 3:
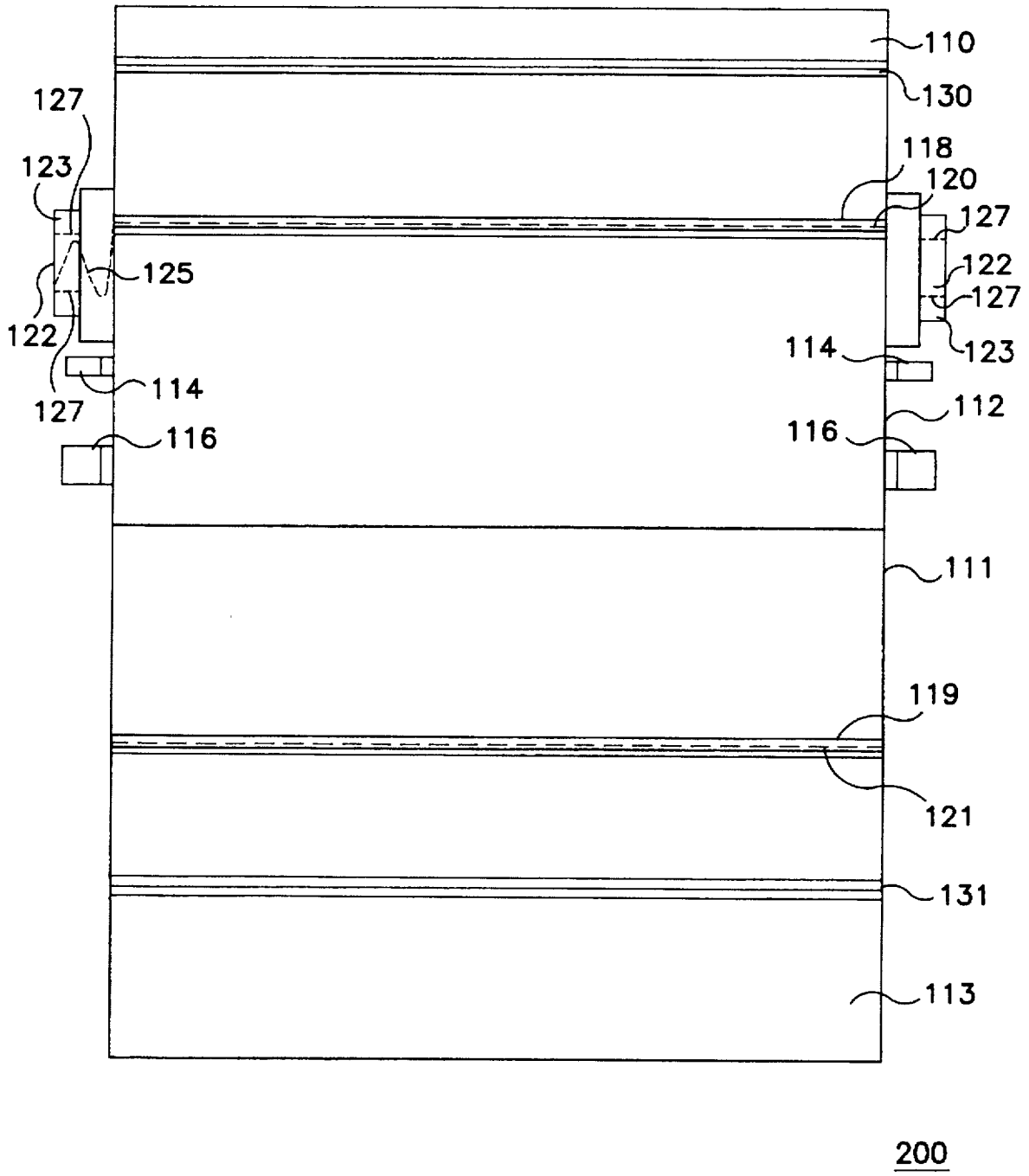
FIG. 3: is a front planar view of a dual roll embodiment of this invention.
Figure 4:
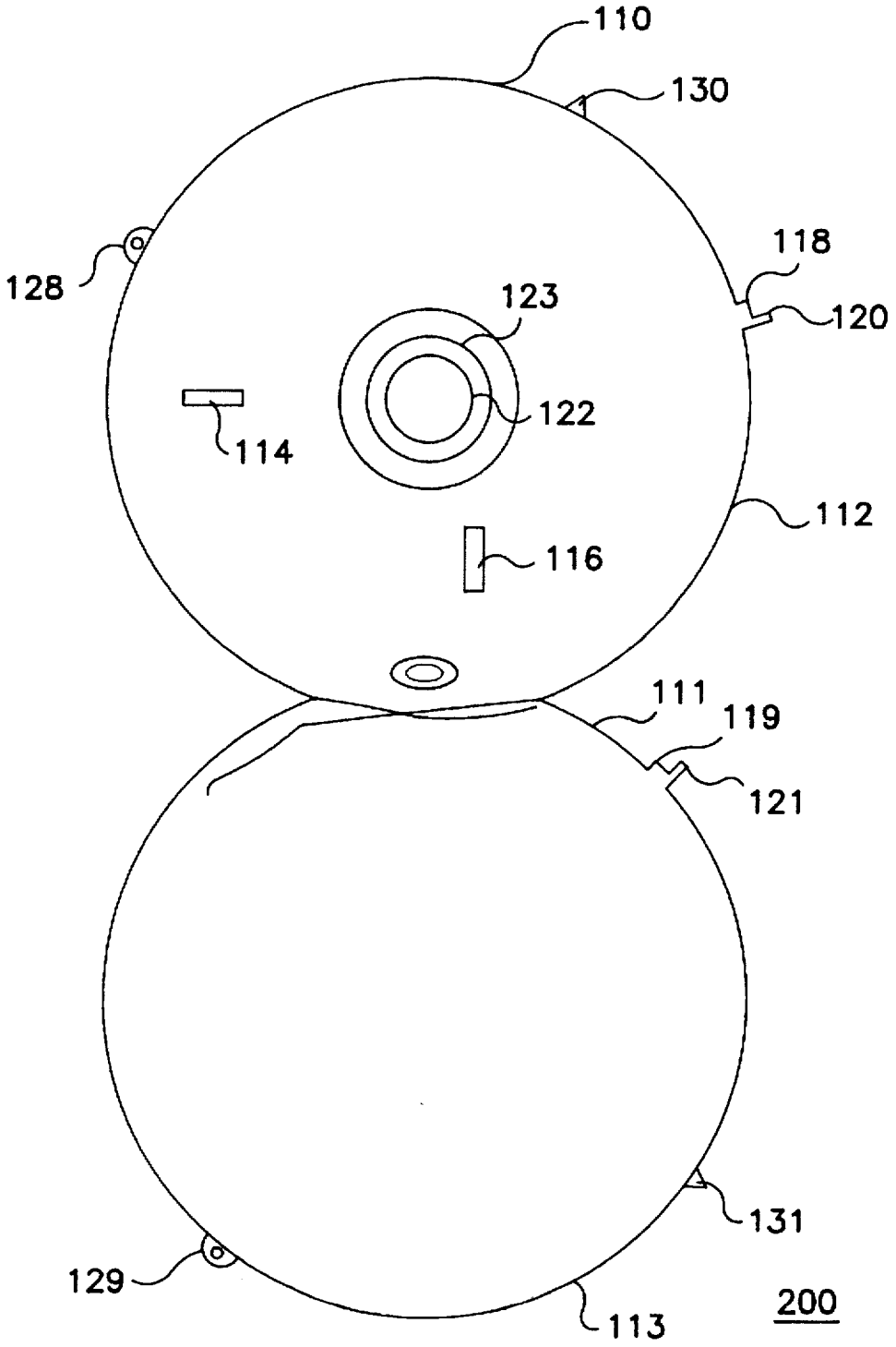
FIG. 4: is a side planar view of the dual roll embodiment of FIG. 3.

With reference to FIGS. 3 and 4, there is shown a preferred dual roll wet towelette dispenser 200. The upper portion of this dispenser 200 is substantially similar to the simple roll dispenser 100, but is equipped with a lower housing 111 for holding the roll of pre-moistened or moist-enable twoellettes, the upper housing 112 in this embodiment holding a roll of dry toilet tissue so that consumers have the option of using both products alternatively or simultaneously as desired.

Similar to the dispenser 100, the dual roll wet towelette dispenser 200 contains a pair of housings 111 and 112 with at least one substantially air-tight lid, or lids 110 and 113, equipped with lid latches 130 and 131. As shown in the particular embodiment FIG. 4, the lids 110 and 113 are located on opposite sides of the dispenser 200 and are equipped with hinges 128 and 129.

Since this dual roll dispenser 200 can be mounted by merely attaching one of the housings, only a single set of breakaway or removable extension tabs 114 and 116 is provided. Although the wet and dry rolls can be inserted alternatively into the upper and lower housings 111 and 112, it is preferred that the upper housing 112 contain the dry toilet tissue roll. Similarly, although a serrated edge 121 is provided in the slotted opening 119, if dry toilet tissue is inserted into the lower housing 111, the serrated edge 112 can be eliminated to save expense.

Figure 5:
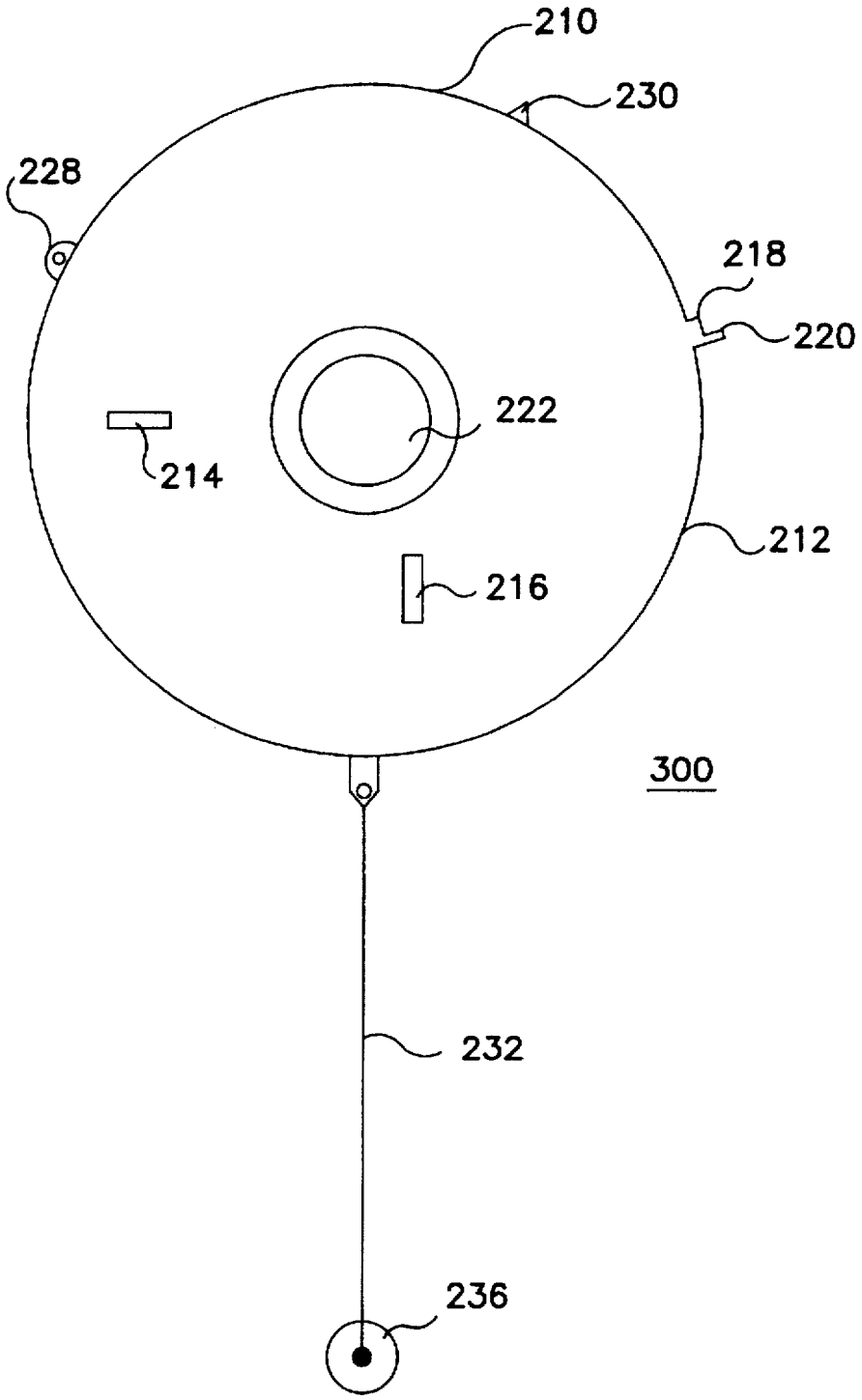
FIG. 5: is a side planar view of an additional embodiment for a dual roll dispenser having a wire supported spindle for holding a dry roll of toilet tissue.

In fact, as illustrated in FIG. 5, the entire lower housing can be eliminated and replaced with a rather conventional dry roll hanger 232 and dry roll spindle 236. This dual roll dispenser 300 mounts a dry roll hanger 232 from a lower surface of the polymeric housing 212. The upper housing 212, for containing the wet towelette roll, is substantially similar to dispenser 100, although the drawing has been simplified somewhat to highlight the dry roll hanger 232 development. As with the earlier described dispensers, dispenser 300 preferably contains at least one spring-loaded button 222, a pair of breakaway or removable extension tab sets (two on each side) 214 and 216, a hinge 228, a latch mechanism 230 attached to a lid 210, and a slotted opening 218 having a serrated edge 220. Dry roll hangers are typically rectangular in shape and contain a spindle of sufficient length (typically about 5.5 inches) to be inserted through the cardboard tube or opening of a dry toilet tissue roll.

The preferred wet towelette roll 15 of this invention will now be described. The roll 15 preferably contains a plurality of pre-moistened towelettes attached to one another by a transverse perforated line. The towelettes are ideally both flushable and biodegradable. One preferred towelette composition for this invention is the "WET WIPES" composition employed by Scott Paper Company. This composition is known to consist of continuous webs of soft fibrous material adhered to a thermoplastic reinforcing layer in selected spaced regions comprising from between about 3% to about 25% of the surface area of the reinforcing layer. The webs hold moisture in an amount of from about 100 to about 300 wt. % based on the dry weight of fibers in the webs. The preferred towelettes of this invention can be biodegradable, especially within a sanitary sewer or landfill, flushable, and hypoallergenic. They can be medicated, for example, with a hemorrhoidal medicine, or anti-bacterial agent, provided with a lubricant, such as mineral oil, and/or a moisturizer, such as lanolin or aloe, just to name a few.

From the foregoing, it will be understood that this invention provides towelettes dispensers for single and dual purpose use. The dispensers of this invention can be mounted in existing brackets without significantly interfering with the other fixtures or requiring often non-existent bathroom shelf space. It is envisioned that the towelettes of this invention will be easier for consumers to accept, since the operation of the dispenser is substantially similar to the typical motion of unwinding tissues from a dry tissue roll.

Although various embodiments have been illustrated, this was for the purpose of describing, and not limiting the invention. Various modifications will become apparent to one skilled in the art, and are considered within the scope of the attached claims.

What is claimed is:

1. A pre-moistened towelette dispenser for dispensing individual towelettes from a plurality of towelettes joined along their transverse perforated edges and wrapped to form a roll, said dispenser being adapted for mounting on a toilet tissue holder, said toilet tissue holder having a first and a second vertically extending bracket member, each bracket member having an upper edge, a lower edge and a recess for supporting a horizontally mounted spindle, said dispenser comprising:

an elongated substantially sealed housing having a first vertical side and a second vertical side, said elongated housing for holding said roll in a substantially horizontal position during use, said elongated housing having a slotted horizontal opening therein for permitting the removal of said individual towelettes from said dispenser;

a first biasing means disposed on said first vertical side of said housing, and a second biasing means disposed on said second vertical side of said housing, said first and second biasing means for insertion into said bracket member recesses for permitting said dispenser to be horizontally supported by said toilet tissue holder; and an upper horizontally extending tab and a lower horizontally extending tab disposed on said first vertical side of said housing, said upper and lower vertically extending tabs for inhibiting the rotation of said housing when said individual towelette is being removed from said dispenser, said upper extending tab for engaging said upper edge of said first bracket member and said lower extending tab for engaging said lower edge of said first bracket member, whereby said housing is supported in said bracket recesses of said toilet tissue holder.

2. The premoistened towelette dispenser of claim 1, wherein said housing further comprises a serrated edge adjacent said slotted opening.

3. The premoistened towelette dispenser of claim 1, wherein said towelettes comprise a water-dispersible synthetic material.

4. The premoistened towelette dispenser of claim 1, wherein said first biasing means further comprises a spring-biased support extending from at least one side of said housing.

5. The pre-moistened towelette dispenser of claim 1, further comprising a guiding roll disposed on a lower portion of said housing, said guiding roll for guiding said roll of towelettes.

6. A combination pre-moistened towelette and dry toilet tissue dispenser for dispensing individual towelettes from a roll of pre-moistened towelettes and dry toilet tissue from a roll of dry tissue, said dispenser for mounting on a toilet tissue holder having a pair of vertically extending bracket members, each bracket member having a recess, and an upper edge and a lower edge, said dispenser comprising:

an elongated substantially sealed container for holding said roll of pre-moistened towelettes in a substantially horizontal position, said substantially sealed container having a slotted opening therein for permitting the removal of said towelettes;

an elongated second container forming an enclosure for holding said roll of dry tissue in a substantially horizontal position, said substantially sealed container being integral with and disposed above said second container;

a pair of biasing means disposed on said substantially sealed container, said biasing means for insertion into said bracket member recesses for permitting said dispenser to be removably supported by said toilet tissue holder; and an upper horizontally extending tab disposed on said first vertical side of said elongated substantially sealed container, and a lower horizontally extending tab disposed on said second vertical side of said substantially sealed container, said upper horizontally extending tab and said lower horizontally extending tab for inhibiting the rotation of said dispenser, said upper horizontally extending tab for engaging said upper edge of said first bracket member and said lower horizontally extending tab for engaging said lower edge of said second bracket member.

7. A system for dispensing pre-moistened towelettes from a toilet tissue holder, said toilet tissue holder having a first vertically extending bracket member and a second vertically extending bracket member, each bracket member having an upper edge, a lower edge and a recess, said bracket member recesses facing each other along a horizontal axis, said system comprising:

a sheet of pre-moistened material provided with semi-perforations at intervals to form individual towelettes, said sheet being wrapped to form a roll; and a dispenser comprising:

an elongated substantially sealed housing having a first vertical side and a second vertical side, said housing holding said roll in a substantially horizontal position during use, said housing having a slotted horizontal opening therein for permitting the removal of said individual towelettes from said dispenser;

a first biasing means disposed on said first vertical side of said housing, and a second biasing means disposed on said second vertical side of said housing, said first and said second biasing means for insertion into said bracket member recesses for permitting said dispenser to be horizontally supported by said toilet tissue holder; and an upper horizontally extending tab disposed on said first vertical side of said elongated housing, and a lower horizontally extending tab disposed on said second vertical side of said elongated housing, said upper horizontally extending tab and said lower horizontally extending tab for inhibiting the rotation of said housing when said individual towelette is being removed from said dispenser, said upper horizontally extending tab for engaging said upper edge of said first bracket member and said lower horizontally extending tab for engaging said lower edge of said second bracket member, whereby said dispenser is removably mounted in said recesses of said toilet tissue bracket members.

8. The dispenser system of claim 7, wherein said towelettes are substantially biodegradable.

9. The dispenser system of claim 7, wherein said towelettes are dispersible in water.

10. The dispenser system of claim 7, wherein said towelettes are hypo-allergenic.

11. The dispenser system of claim 7, wherein said towelettes hold moisture in an amount of from about 100 to about 300 wt. %.

12. The dispenser system of claim 7, wherein said pre-moistened material comprises a reinforcing layer bonded intermittently to a soft fibrous layer.

13. A pre-moistened towelette dispenser for dispensing individual towelettes from a plurality of towelettes joined along their transverse perforated edges and wrapped to form a roll, said dispenser for mounting on a toilet tissue holder, said toilet tissue holder having a first and a second vertically extending bracket member, each bracket member having an upper edge, a lower edge and a recess for supporting a horizontally mounted spindle, said dispenser comprising:

an elongated substantially sealed housing having a first vertical side and a second vertical side, said elongated housing for holding said roll in a substantially horizontal position during use, said elongated housing having a slotted horizontal opening therein for permitting the removal of said individual towelettes from said dispenser;

a first biasing means disposed on said first vertical side of said elongated housing, and a second biasing means disposed on said second vertical side of said elongated housing, said first and second biasing means for insertion into said bracket member recesses for permitting said dispenser to be horizontally supported by said toilet tissue holder; and an upper horizontally extending tab disposed on said first vertical side of said elongated housing, and a lower horizontally extending tab disposed on said second vertical side of said elongated housing, said upper horizontally extending tab and said lower horizontally extending tab for inhibiting the rotation of said housing when said individual towelette is being removed from said dispenser, said upper horizontally extending tab for engaging said upper edge of said first bracket member and said lower horizontally extending tab for engaging said lower edge of said second bracket member, whereby said housing is supported in said bracket recesses of said toilet tissue holder.

* * * * *